United States Patent [19]

Nishimura

[11] 4,270,781

[45] Jun. 2, 1981

[54] OPENING AND CLOSING APPARATUS FOR DOORS AND THE LIKE

[75] Inventor: Tamotsu Nishimura, Osaka, Japan

[73] Assignee: Futaba Kinzoku Kogyo Kabushiki Kaisha, Osaka, Japan

[21] Appl. No.: 43,644

[22] Filed: May 30, 1979

[30] Foreign Application Priority Data

Feb. 28, 1979 [JP] Japan ..... 54-26071[U]

[51] Int. Cl.[3] ..... E05C 19/16

[52] U.S. Cl. ..... 292/251.5; 292/DIG. 4

[58] Field of Search ..... 292/251.5, DIG. 4

[56] References Cited

U.S. PATENT DOCUMENTS

| | | | |
|---|---|---|---|
| 3,492,037 | 1/1970 | Hutchinson | 292/251.5 |
| 3,934,909 | 1/1976 | Van Natter | 292/251.5 |
| 4,026,588 | 5/1977 | Bisbing et al. | 292/251.5 |

FOREIGN PATENT DOCUMENTS

| | | | |
|---|---|---|---|
| 548736 | 7/1956 | Belgium | 292/DIG. 4 |
| 1067335 | 10/1959 | Fed. Rep. of Germany | 292/251.5 |
| 2017201 | 10/1979 | United Kingdom | 292/251.5 |

*Primary Examiner*—William E. Lyddane

*Attorney, Agent, or Firm*—Wenderoth, Lind & Ponack

[57] ABSTRACT

An opening and closing apparatus for doors and the like includes magnets and metal plates which are located superposed inside a casing. Either the magnets or the metal plates are adapted to be slidable inwardly and outwardly of the casing and the other of the magnets or metal plates is secured to the inside of the casing. The metal plates are shaped so that the slidable element overlaps a great amount with the secured element when the slidable element is located inside the casing, and has a reduced or substantially no overlap with the secured element when the slidable element is located on the outside of the casing. The slidable element is mounted on an engaging member which is urged outwardly from the casing by a spring which is located adjacent the opening of a box-like body, there being a locking assembly provided which includes a lock which is capable of locking the engaging member when it is manually pushed and releasing it when it is manually pushed a second time. A magnetic member is mounted on the door or the like at a position opposite to the locking assembly.

3 Claims, 7 Drawing Figures

OPENING AND CLOSING APPARATUS FOR DOORS AND THE LIKE

BACKGROUND OF THE INVENTION

The present invention relates to an opening and closing apparatus for a door or lid of an audio rack or a similar box-like body. The apparatus enables the user to lock and smoothly release the lock of the door or lid by simply manually pushing it toward the box-like body.

There are presently known opening and closing apparatuses which allow simple locking and unlocking of the door or lid of an audio rack or a similar box-like body simply pushing it toward the body of the rack or box. According to the presently known devices, when a sliding member of a locking assembly is pushed as a result of closing the door, the sliding member is retained locked inside its casing thereby enabling a magnet which is mounted on the sliding member to magnetically lock the door or the like. When the door is pushed a second time, the sliding member projects beyond the casing and thereby releases the door or the like and opens the box-like body.

According to the conventional devices, however, the door is still urged closed by the magnet even when the sliding member projects outwardly beyond the casing. In order to open the door, therefore, it becomes necessary that the door be detached from the magnet against its attracting force. Since this operation causes a shock to the box-like body, it creates a problem by causing the stylus to skip in the case when the box-like body is used an audio rack.

SUMMARY OF THE INVENTION

The present device has as an object to eliminate the aforementioned problem. A preferred embodiment thereof will now be described in detail in reference to the accompanying drawings.

DETAILED DESCRIPTION OF THE INVENTION

Figure 1:
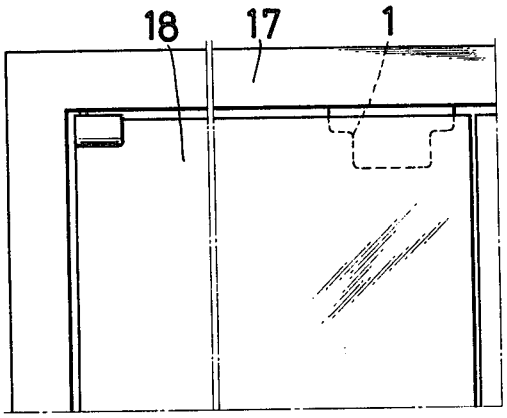
FIG. 1 is a front elevation view of a preferred embodiment of the device of the present invention.
Figure 2:
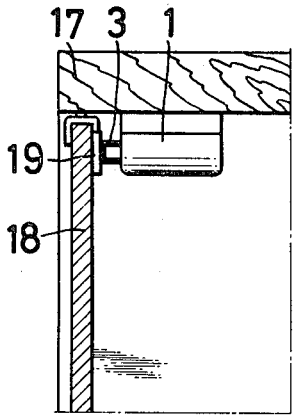
FIG. 2 is a side view of the device shown in FIG. 1 same.
Figure 3:
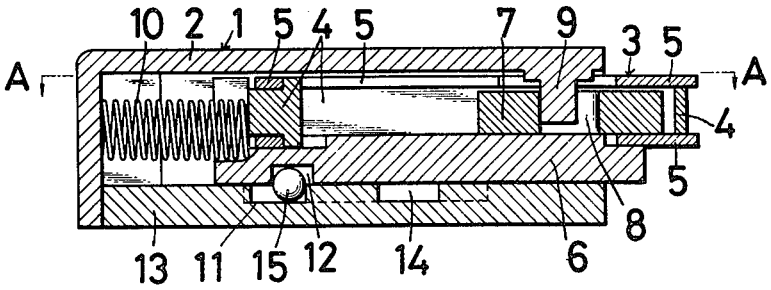
FIG. 3 is a side view, in cross-section on a magnified scale, of the locking assembly.
Figure 4:
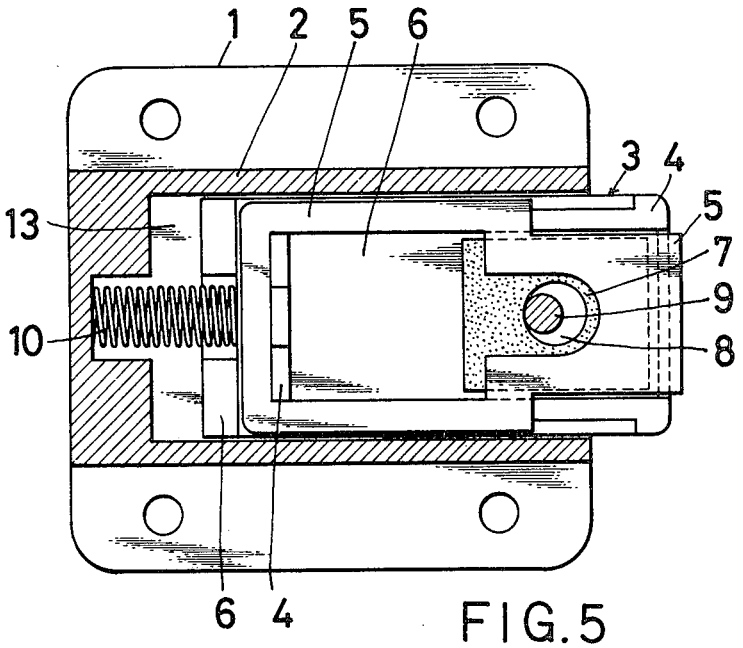
FIG. 4 is a sectional view taken along the line A-A of FIG. 3.
Figure 5:
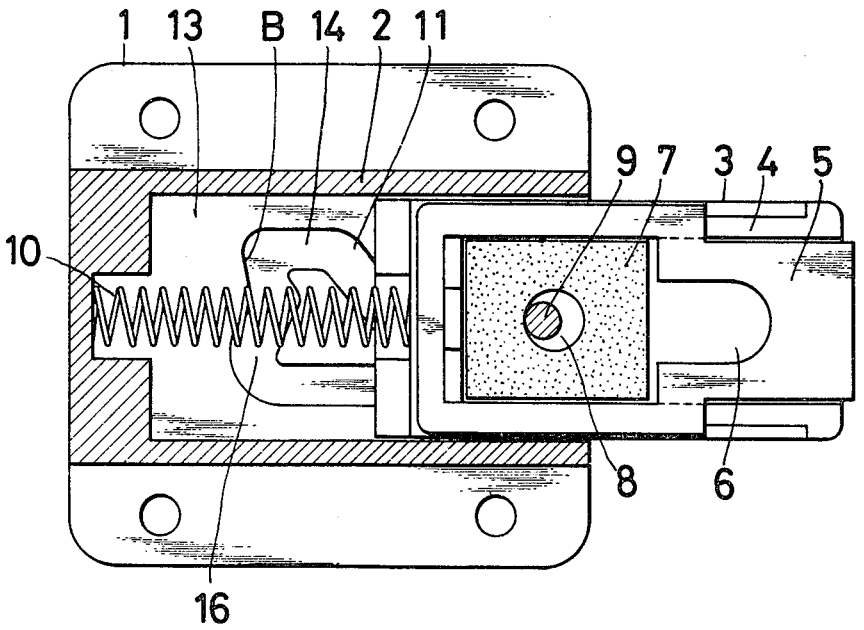
FIG. 5 is a sectional view taken along the line A-A when the sliding member is displaced outside of the casing.

The numeral 1 designates a locking assembly which includes sliding members which are capable of being locked by a first push and unlocked by a second push. The numeral 2 designates a casing of the locking assembly which is made of a nonmagnetic material and which is open at one end thereof. The numeral 3 designates a sliding member which is located inside the casing 2 so as to be slidable inwardly and outwardly through an opening in the casing 2. The sliding member 3 includes frame-like metal plates 5 and 5 which are superposed on both faces of a frame body 4 which is made of a nonmagnetic material, such as a synthetic resin and the like, and an engaging member 6 which is made of a nonmagnetic material and is superposed on one of the metal plates 5. The assembly is adapted to be integrally slidable. The forward ends of the metal plates 5 and 5 are adapted to either project beyond the frame body 4 or to be level therewith. The frame body 4, the metal plates 5 and 5 and the engaging member 6 can, as one option, be made integral by, for example, engaging them by partially meshing them with each other or by connecting them by means of an adhesive or small screws. The numeral 7 designates a magnet which is mounted between the metal plates 5 and 5 inside the frame body 4, the magnet 7 has a size so as to be capable of sliding relative to the sliding member 3 within a predetermined range inside the frame body 4 and between the metal plates 5 and 5 in a direction which is parallel therewith. There is hole 8 for engagement which is located on the magnet 7 in the direction of superposition of the metal plates 5 and 5. The magnet 7 is permanently attached to the opening of the casing 2 by the engagement at the hole 8 by a pin 9 which is located on the inner face of the casing 2. Each metal plate 5 has a notch which has having a sufficient length to permit it to slide without interference from the pin 9. Further, each metal plate is adapted so as to overlap the greatest amount with the magnet 7 when the sliding member 3 is urged to the maximum distance into the casing 2 having a reduced overlap when the sliding member 3 is displaced out from of the casing 2 until the overlap is zero or at a minimum, thereby enabling the magnetic force of the magnet 7 acting upon the metal plates 5 and 5. The notch at each metal plate 5 is adapted to have a smaller width at its forward end and a larger width at its rearward end so that the magnetic influence can ultimately be nullified or minimized. The particular shape of the notch of the metal plate 5 is optional, further, the metal plate 5 can be cut away at one edge thereof.

The numeral 10 designates a spring which is located inside the casing 2 for urging the sliding member 3 outwardly from the casing 2. The numeral 11 designates a lock means which is adapted for locking the sliding member 3 when it is pushed into the casing 2 and for releasing it when it is pushed a second time. The lock means 11 includes a groove 12 which is located on one face of the engaging member 6 and at right angles to the sliding direction of the engaging member 6. A substantially ring shaped guide groove 14 is located opposite to the groove 12 on a bottom plate 13 which is secured to the casing 2 in parallel relation to the engaging member 6. A ball 15 which has a diameter so as to extend into both the grooves 12, and 14 is fitted therebetween. The guide groove 14 includes a curved portion 16 on the inner side of the casing 2 which curves toward the opening of the casing 2 and an engaging recess (A) is provided on the forward side wall of the curved portion 16, while a guide slope (B) is provided on the rear wall thereof, the position of the engaging recess (A) and that of the guide slope (B) being such that they are shifted relative to each other. The numeral 17 designates a box-like body of an audio rack or the like. A locking assembly 1 is mounted on the inside of the top plate adjacent the opening of the box-like body 17 with the opening of the casing 2 directed outwardly from the box-like body 17. Alternatively, the locking assembly 1 can be mounted on the bottom plate of the box-like body 17. The numeral 18 designates a door which is pivotally mounted on one end of the box-like body 17 and magnetically attractable member 19 which is made of metal is mounted on the inside of the door 18 so as to be brought into contact with the sliding members 3.

The preferred embodiment includes a box-like body which has a door which is opened in a forward direction away from the body. The same arrangement is applicable also to a box which has a lid which can be opened in an upward direction so that the casing can be mounted on the side wall of the box-like body, and the magnetically attractable member can be mounted on the inside of the lid.

Figure 7:
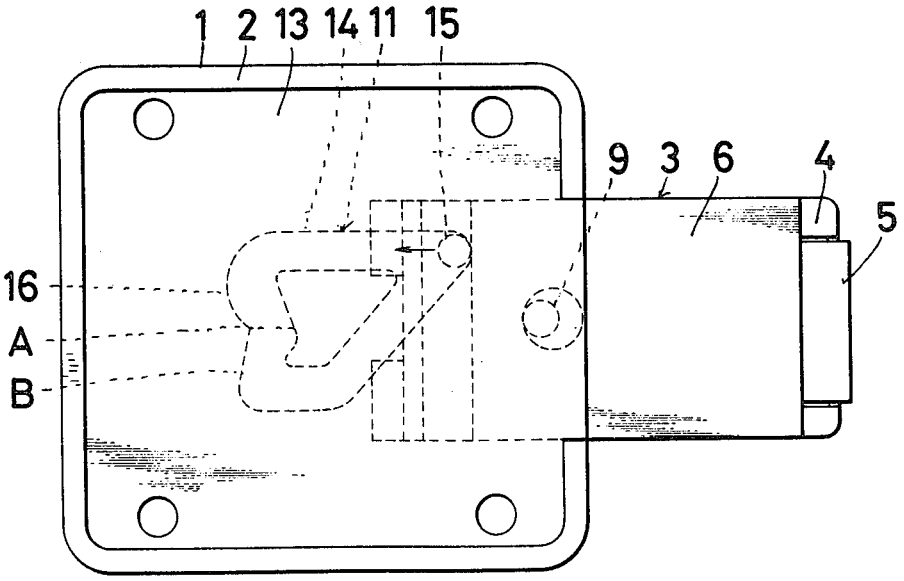
FIG. 7 is a bottom view of the locking assembly when the slider is displaced outside of the casing.

The opening and closing apparatus for doors or the like according to the present invention has a construction as described hereinbefore. When the door is open, the sliding member 3 projects beyond the casing 2 as shown in FIG. 7. In order to close the door, the magnetically attractable member 19, which is secured to the door is brought into contact with the sliding member 3, the sliding member 3 being pushed into the casing 2 against the bias of the spring 10 by appropriately positioning the door. Subsequently, as shown in FIG. 7, the ball 15, which is located at a position which is most forwardly in the guide groove 14, is displaced along the guide groove 14 in the direction indicated by the arrow by being pushed on the engaging plate 13 through the groove 12 until the ball 15 is brought substantially to the center of the curved portion 16 of the guide groove 13. When the ball is brought to the curved portion 16 of the guide groove 14, the sliding member 3 comes to a stop. When the door is released from the manual push, the sliding member 3 which is urged, by the spring 10, outwardly of the casing 2 is locked with the ball 15 by engaging the engaging recess (A) of the guide groove 14. When the sliding member 3 is pushed into the casing 2, the overlap between the metal plates 5 and 5, and the surface area of magnet 7 is enlarged, thereby the magnetically attractable member 19 is forcefully attracted by the magnet 7 through the metal plates 5 and 5. Thus, the door is retained closed.

The door can be opened by manually pushing it a second time. The ball 15 is displaced to the side of the guide slope (B) by being pushed by the engaging plate 13 through its groove 12 so that the ball 15 is then brought to the end of the curved portion 16 along the guide slope (B). Thus, the sliding member 3 is unlocked and brought to a stop. Further, if the door is released from the manual push, the sliding member 3, which is urged by the spring 10, is displaced outwardly from the casing 2 so that the door is detached from the box body. The sliding member 3 is brought to a stop when the ball 15 is displaced along the guide groove 14 until it is located in the forward side of said guide groove 14. Though the sliding member 3 slides outwardly from the casing 2, the magnet 7 is maintained stationary through the engagement of the pin 9. Thus, the sliding member 3 is displaced against the attraction of the magnet 7 which acts on the sliding member 3 through the metal plates 5 and 5. However, since the metal plates 5 and 5 slide on both sides of the magnet 7 in a direction parallel therewith, the sliding member 3 is capable of sliding in a manner which is simple and smooth and completely free of shocks. Furthermore, each metal plate 5 is cut away in part in the shape of a frame or the like so that the overlap with the magnet 7 is reduced accordingly as the sliding member 3 slides outwardly from the casing 2. The reduced attraction of the magnet 7 acting upon the metal plates 5 and 5 and the magnetically attractable member 19 allows the sliding member 3 to slide with greater smoothness and simplicity. Moreover, when the sliding member 3 has completed its sliding movement, the magnetically attractable member 19 and the magnet 7 are spaced widely apart from each other whereby the attraction of the magnet 7 acting upon the magnetically attractable member 19 is nullified or minimized. More precisely, the door is detached from the opening of the box-like body by the sliding of the slider 3 and synchronously released from the attraction of the magnet 7 which acts on the magnetically attractable member 19. The box-like body is completely free of shocks which are likely to be caused by the subsequent swing of the door. Thus, the problem of shocks involved in the detachment of the door from the magnet 7 can be obviated in a simple manner.

In the case of a box-like body having an upwardly opening lid, the lid is smoothly raised by the sliding member 3 in accordance with the aforementioned description. Subsequently, the lid can be opened by hand.

Figure 6:
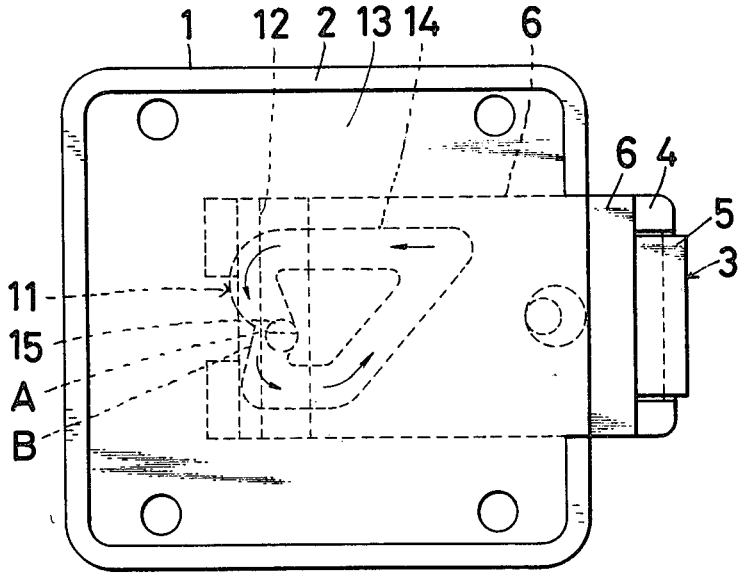
FIG. 6 is a bottom view of the locking assembly.

The locking assembly 11 for locking the sliding member 3 is not necessarily restricted to that of the embodiment described insofar as it is capable of locking the sliding member 3 when it is pushed and unlocking it when pushed a second time. For example, Utility Model No. SHO-47-35380 discloses a device which includes a hook-shaped rotary disk which is pivotally supported at one end thereof and provided with a substantially upright tongue portion, a pin is erected on a sliding member for causing the rotary disk to rotate when the sliding member is pushed, so that synchronously, the sliding member is locked by being caught on said pin. When the sliding member is pushed a second time, the tongue of the rotary disk is superposed on the pin thereby releasing the sliding member, the sliding member being caused to project by a spring with the pin passing under the rotary disk. Further, Utility Model No. SHO-52-144917 discloses a device wherein a projection is provided on the inner face of a tubular body, an engaging member, which is a round bar, is fitted into the tubular body. A guide groove having an engaging recess and a guide slope as shown in FIG. 6, extends in a ring-like shape on the periphery of the engaging member, and a groove extends axially and internally from the engaging member which is provided in the guide groove. When the sliding member is pushed, the projection of the tubular body is caught in the engaging recess of the engaging member thereby locking the sliding member. When the sliding member is pushed a second time, the projection is displaced from the guide slope to the interior of the groove which extends axially from the engaging member thereby releasing the sliding member.

Generally, when a magnet is used to attract metal, a stronger attraction can be obtained by interposing metal plates as shown in the embodiment of the invention as compared with the case of a direct application of the magnet to the metal. Thus, the magnet 7 can have a relatively small magnetic force. When the magnetically attractable member 19 is indirectly attracted by the magnet 7, the member 19 can be detached relatively easily without giving a shock to the box-like body. In reverse to the instance of the present embodiment, the magnet 7 can be adapted to slide together with the engaging member with the metal plates 5 and 5 secured to the casing 2. Thus, when the door is closed, it is forcefully attracted by the magnet with interposition of the metal plates 5 and 5, at the same time as the sliding member is displaced outwardly from the casing 2 to open the door, the magnet 7 alone attracts the magnetically attractable member 19, so that the door is smoothly detachable from the magnet 7. The magnet 7 can be adapted to slide by securing the metal plates 5 and 5 to the casing 2 in an axial direction in parallel with the pin 9 so that the magnet 7 which is mounted on the engaging member can slide therebetween.

What is claimed is:

1. An opening and closing apparatus for doors and the like, said apparatus comprising:

a hollow casing having an opening at one end; said casing adapted for mounting on a cabinet adjacent a door of said cabinet;

a sliding member positioned inside said casing for sliding into and for extending out of said casing;

magnetic means attached to said casing on the inside of said casing, said sliding member comprising metal plates located superposed on each side of said magnetic means for having a magnetic field transferred thereto; said metal plates having cutaway portions for allowing a maximum overlap with said magnetic means when said sliding member is positioned within said casing and a minimum overlap when said sliding member is positioned extending out of said casing;

an engaging member having said sliding member mounted thereon, said engaging member being slidably received within said casing;

spring means positioned within said casing adjacent said engaging member for urging said engaging member out from said casing;

lock means operatively associated with said engaging member for holding said engaging member within said casing when it is first manually pushed against the direction of urging of said spring means and for allowing said engaging member to slide and project from said casing when it is pushed manually a second time against the direction of urging of said spring means, said lock means comprising retaining means for holding at least a portion of said engaging member within said casing when said engaging member projects out from said casing with said sliding member; and a magnetically attractable element adapted for mounting on the door of a cabinet for contacting said sliding member when the door is closed whereby the door can be held closed by closing the door and pushing said sliding member into said casing for having said lock means hold said engaging member in said casing thereby causing said metal plates to have a maximum overlap with said magnetic means and a maximum magnetic force transferred thereto for holding said magnetically attractable element against said sliding member, said door being opened by pushing said sliding member into said casing a second time for causing said lock means to release said engaging member thereby having said spring means move said sliding member out from said casing and reducing the overlap of said metal plates with said magnetic means for reducing the magnetic force acting on said magnetically attractable element for allowing said door to open.

2. An opening and closing apparatus as in claim 1 wherein said magnetic means comprises a magnet which is secured to said casing.

3. An opening and closing apparatus as in claim 1 wherein said engaging member comprises, a slidable plate having a groove on the bottom surface thereof which extends in a direction transverse to the direction of sliding of said slidable plate, and said lock means comprises a substantially ring-shaped groove on the inside bottom wall of said casing, said groove having a notch-like section centrally located at its inner most side and downward slope portion adjacent said notch-like portion, and a ball, said slidable plate positioned with respect to said substantially ring shaped groove for having said ball simultaneously received in both said slidable plate groove and said substantially ring-shaped groove.

* * * * *